US007300319B2

(12) United States Patent
Lutsch et al.

(10) Patent No.: US 7,300,319 B2
(45) Date of Patent: Nov. 27, 2007

(54) ELECTRICAL CONTACT

(75) Inventors: Harald Michael Lutsch, Langen (DE); Vladimir Buden, Zagreb (HR); Ivica Jakoplic, Krapinske Toplice (HR); Rachid Ainceri, Darmstadt (DE)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/553,207

(22) Filed: Oct. 26, 2006

(65) Prior Publication Data

US 2007/0123093 A1 May 31, 2007

(30) Foreign Application Priority Data

Oct. 27, 2005 (DE) ..... 10 2005 051 724

(51) Int. Cl.
*H01R 11/22* (2006.01)

(52) U.S. Cl. ..... 439/852; 439/845

(58) Field of Classification Search ..... 439/842–845, 439/851–853, 856
See application file for complete search history.

(56) References Cited

U.S. PATENT DOCUMENTS 5,470,258 A 11/1995 Suzuki et al.
6,102,752 A 8/2000 Bommel et al.

FOREIGN PATENT DOCUMENTS

DE 692 21 539 T2 12/1992
DE 200 13 570 U1 1/2001
DE 101 50 438 A1 4/2003
DE 102 44 946 A1 4/2003
EP 0 517 139 A2 12/1992
EP 0 774 801 A2 5/1997
EP 0 971 446 A2 1/2000
EP 1 289 071 A2 3/2003

*Primary Examiner*—Khiem Nguyen
(74) *Attorney, Agent, or Firm*—Sughrue Mion Pllc.

(57) ABSTRACT

Electrical contact comprising a contact element, which has a connection portion, which serves for the electrical conducting connection to an electrical conductor, but a contact holding portion connected integrally to the connection portion, for contacting a counter contact, and a support element, which encloses the contact holding portion at least at a portion of its length along a longitudinal axis and formed in cross-section as a hollow rectangle delimited by four walls, has along the longitudinal axis a front end and a rear end facing the connection ports. Further, the support element has along the longitudinal axis (4) a front end (16) and a rear end (17), with the rear end (17) facing the connection portion (5), has a first projection (18) close to the front end (16), which first projection (18) has a first insertion portion (19) which distance from the longitudinal axis (4) increases in a direction from the front end (16) towards the rear end (17) and has side walls (22) and ends with an end edge (20), has a second projection (23) close to the rear end (17), which second projection (23) has a second insertion portion (24), which distance to the longitudinal axis (4) increases in a direction towards the rear end (17) in an inclined manner away from the first projection (18) relative to the longitudinal axis (4), wherein the first projection (18) as well as the second projection (23) are formed by non-cutting working from one of the walls (12, 13, 14, 15), so that they project away from the longitudinal axis (4) from that wall (14).

9 Claims, 9 Drawing Sheets

ELECTRICAL CONTACT

BACKGROUND OF THE INVENTION

The invention relates to an electrical contact with a contact element, which has integrally a connection portion and a contact holding portion, wherein the contact holding portion serves to be connected to a mating contact. The connection portion serves to connect for example by means of crimping an electrical conductor in an electrically conducting manner and if necessary additionally to produce a holding connection to the insulation of the cable having the conductor. The contact element is enclosed at its portion having the contact holding portion at least partially by a support element, which is also called cantilever spring and is, for example, made from a material, which has a higher strength than the contact element itself, i.e. from a steel. Such a support element is commonly made by starting from a sheet metal, i.e. by means of bending and punching as well as material connection of the butt joints by means of point welding or producing welding seams. The support element supports the contact element, so that for example contact arms belonging to the contact holding portion provided in form of elastic tongues are held securely. Furthermore, the support element serves to hold the contact securely in a housing.

A multitude of such electrical contacts are for example provided in connections, used in motor vehicles on wire harnesses or for connecting electrically operated equipment elements of a motor vehicle. Such connectors have housings, in which often in several rows, one on top of another and next to each other accommodation chambers are formed, which respectively, accommodate an electrical contact. Additionally to each accommodation chamber a locking element in form of an elastic arm is arranged, which rests with a projection behind a corresponding contour of the contact and especially its support element, so that the contact is securely retained against pulling-out from the housing. Often so-called secondary locking means are also provided. Even if pulling forces act on the cable connected to the individual contacts, the electrical contact should be securely held in the connector.

Additionally, depending on the application field, also the sealing of such connectors is important, as for example in the engine compartment of a motor vehicle a moist environment exists. Spray water can enter the area of such a connector. Because of this reason the individual electrical contacts have to be also sealed. This can be achieved such, that to each individual electrical contact a special seal is arranged, which sits in a corresponding opening, which is arranged in front of the accommodation chamber for the electrical contact. Alternatively, the end of the connector, from which the contacts are inserted into the housing, is provided with a seal, which covers the whole area of all insertion openings and has corresponding insertion openings for respectively one contact element, aligned to the individual chambers. As such electrical contacts are inserted normally after the assembly of the seals into the accommodation chambers of the connector, the electrical contacts have to be formed such, that a damage of the seal and thus a place of intrusion is prevented.

U.S. Pat. No. 5,470,258 describes a connector, which housing has several accommodation chambers, to which respectively a locking arm is arranged, which abuts a projection on an unitarily formed contact element, which projection is produced by means of multiple folding. This citation describes a secondary locking for the contact element. A seal is not provided.

An electrical contact, which offers a projection-free support possibility for a locking arm for securing an electrical contact in an accommodation chamber of a connector, is described in EP 0 971 446 B1 and the parallel U.S. Pat. No. 6,102,752 A and DE 699 10 697 T2.

The electrical contact shown there comprises a contact element, which has a connection portion in form of crimping tabs for connecting a cable and a conductor thereof for achieving an electrically conductive connection. Following the connection 3 portion a contact holding portion with elastic contact arms is integrally formed. The contact holding portion is enclosed by a support element, which is adapted to the cross-section thereof. The support element has four walls, forming in cross-section a hollow rectangle, wherein the upper wall has a tongue punched therefrom, serving for supporting one of the spring arms. At a height distance to the upper wall, a further wall is provided, which is connected integrally to one of the side walls. The further wall extends parallel to the upper wall and has portions which are bent downwards to the side walls or to the upper wall. The further wall has, furthermore, a recess, which edge facing the front end serves as a support base for a projection of a locking arm on a connector. Thus a relative smooth surface is formed, which serves that, when inserting such a contact into a chamber of a connector closed by a seal, no damage is produced on the seal. However, the support element is cumbersome to manufacture and necessitates because of the multi-layer construction, i.e. of the additional arrangement of the further wall, arranged above the upper wall, a relative large sheet metal portion, from which the support element is bent. The manufacturing costs and also the costs for the material are correspondingly high. The cross-section is correspondingly large.

DE 200 13 570 U1 describes an electrical contact for the use in connection with connectors, wherein the contact element is formed unitarily, i.e. has a connection portion formed from a sheet metal portion and a contact portion, formed as a female contact. This contact portion is provided in cross-section as a hollow rectangle delimited by four walls. In this case from one of the walls a retaining shoulder in form of a projection is formed, which has an edge, against which a projection of a locking arm, belonging to a connector, can be abutted. To prevent the problem of damaging a seal, a rib-like guide element is laterally arranged to the projection, which guide element, when inserting a contact through the opening of a seal, expands the opening such, that damages are prevent.

SUMMARY OF THE INVENTION

The invention is based on the object, to provide an electrical contact with a two-part construction, i.e. with a contact element and a support element enclosing the contact element, for which the material expenditure for the support element is reduced and, furthermore, can be manufactured in a simple manner, wherein its elements, serving for the retainment in an accommodation chamber of a connector, are formed such, that damages on the connector and its seal are prevented.

This object is solved according to a first embodiment of the invention by a electrical contact comprising a contact element, which has a connection portion for an electrically conducting connection to an electrical conductor, has a contact holding portion, connected integrally to the connection portion, for contacting a mating contact, and a support element, which encloses the contact holding portion at least at a length portion thereof along a longitudinal axis and formed in cross-section as a hollow rectangle delimited by four walls, has along the longitudinal axis a front end and a rear end, with the rear end facing the connecting portion, has a first projection close to the front end, which first projection has a first insertion portion which distance from the longitudinal axis increases in a direction from the front end towards the rear end and has side walls and ends with an end edge, has a second projection close to the rear end, which second projection has a second insertion portion, which distance to the longitudinal axis increases in a direction towards the rear end in an inclined manner away from the first projection relative to the longitudinal axis, wherein the first projection as well as the second projection are formed by non-cutting working from one of the walls, so that they project away from the longitudinal axis from the wall.

Of advantage herein is, that one of the four walls comprises in-situ the projection, of which an edge is used, to form a support base for the locking arm of a connector. As the two projections are formed in situ by non-cutting working from the wall, smooth transitions can be achieved, so that a damage of a seal is prevented during the assembly of the contact, i.e. during the insertion into an accommodation chamber, during which a seal has to be passed. The second projection effects a guide and an advantageous alignment to the accommodation chamber and can be used as a support base for the secondary locking means, additionally to the locking arm supported on the first projection.

As a whole the advantage is achieved, that for the manufacture of the support element only a very low amount of material is necessary, as only one of the commonly provided four walls is used in situ for forming the projections. As the end edge of the first projection facing away from the insertion portion is separated from the mating wall, a clearly defined edge is produced, which faces in the direction towards the second projection and which is used as a support base for the projection of a locking arm.

A specifically advantageous effect is achieved by the fact, that the first projection and the second projection even after the non-cutting forming in situ from the base material of the wall of the support element, to which wall they are arranged, are connected via their side walls to this wall, while the end edge of the first projection is separated from the base material of the wall and serves as a support base for the locking arm of a connector.

An especially advantageous embodiment is achieved, when the front end of the support element has a cap portion with a central through opening, which is formed integrally with one of the four walls. The cap portion can be connected to the remaining walls in a material connecting manner, e.g. by means of one or more welding spots. This cap portion covers at least partially the front end of the open cross-section, which is formed by the four walls. It can be formed such, that soft transitions are achieved. The central opening can for example be used, that a connector pin exits therefrom or it serves as an empty opening for a flat connector pin of a corresponding mating contact.

To prevent also when pulling out such an electrical contact from an accommodation chamber through a seal, that the seal is damaged, it is provided, that the second projection has towards the rear end a wall portion bent in the direction towards the longitudinal axis. This also forms a good abutment for a secondary locking means. An advantageous possibility of the manufacture is achieved, if the support element is formed from a sheet metal portion by means of non-cutting forming of the two projections and of the cap, by means of bending into the final shape and if necessary by welding points at the joints.

Preferably, it is in this case provided, that the two projections and the cap are formed from a portion of a sheet metal portion, from which the support element is formed, which is foreseen to form the wall, which will have the projections.

To effect an advantageous support of the first projection on a locking arm of a connector, it is provided, that the first projection has in the direction towards the second projection an open portion. This open portion is achieved such, that during the manufacture of the first projection initially a separation in form of a linear cut from the sheet portion, forming the wall foreseen for having the two projections is carried out and then the first projection is formed by non-cutting working. This has the advantage, that the forming of the first projection can be carried out advantageously and at the same time an advantageous edge for the support of the locking arm is formed.

The object based on the invention is also solved by an electrical contact comprising a contact element, which has a connection portion for an electrically conductive connection to an electrical conductor, has a contact holding portion connected integrally to the connection portion for contacting a counter contact, and a support element, which encloses the contact holding portion at least at a length portion thereof along the longitudinal axis and is formed in cross-section as a hollow rectangle delimited by four walls and has along the longitudinal axis a front end and a rear end, which rear end faces the connection portion, has in one of the walls a recess extending along the longitudinal axis and which recess is delimited towards the front end by a first edge extending transversally to the longitudinal axis and by second edge off-set relative to first edge to the rear end, to which second edge a tongue is attached, which extends initially towards the longitudinal axis and then towards the first edge.

In this embodiment the advantages, as they were described in connection with the first embodiment are also achieved. In the first embodiment the advantage exists, that as a whole a rigid construction is achieved, while the recess in the second embodiment represents a weakening in a limited manner, which is, however, acceptable depending on the application.

In an embodiment of the second solution according to the invention it is provided, that the front end of the support element has a cap portion with a central through opening, which is formed integrally with one of the four walls and that the cap portion can be connected in a material connecting manner to at least one of the remaining walls, e.g. by means of a welding spot or by similar measures.

Furthermore, for the reinforcement and for forming advantageous abutment edges it is provided, that the wall having the recess has at the front end and/or rear end a wall portion bent in the direction towards the longitudinal axis.

Advantageous is, when the cap portion is formed integrally with a different wall as that, having the recess. As a whole by means of the cap, when it is connected also to the other walls in a material locking manner, e.g. by means of welding, an immense increase in strength is achieved, wherein this is also valid for the cap in the first embodiment.

Preferably, the electrical contact is formed as a female contact, for what it is provided, that the contact holding portion has elastic contact arms, which accommodate a mating contact formed as a connector pin or as a flat connector pin, between them. This is also valid for both solutions according to the invention. For the second solution according to the invention it is provided, to improve the support of the contact arms in the area of the recess, that the tongue serves as an abutment for an elastic contact arm.

As a whole it has to be noted, that the electrical contacts according to the invention are those, which are preferably used in miniature form, i.e. which, for example, in the construction as a female contact serve for the insertion of connector pins having a width of 0.64 mm.

BRIEF DESCRIPTION OF THE DRAWINGS

Two solutions according to the invention are shown schematically in the drawing. It shows

DETAILED DESCRIPTION OF THE INVENTION

Following, in the description it is referred to FIGS. 1 to 5 as a whole concerning a first embodiment of a contact 1.

Figure 1:
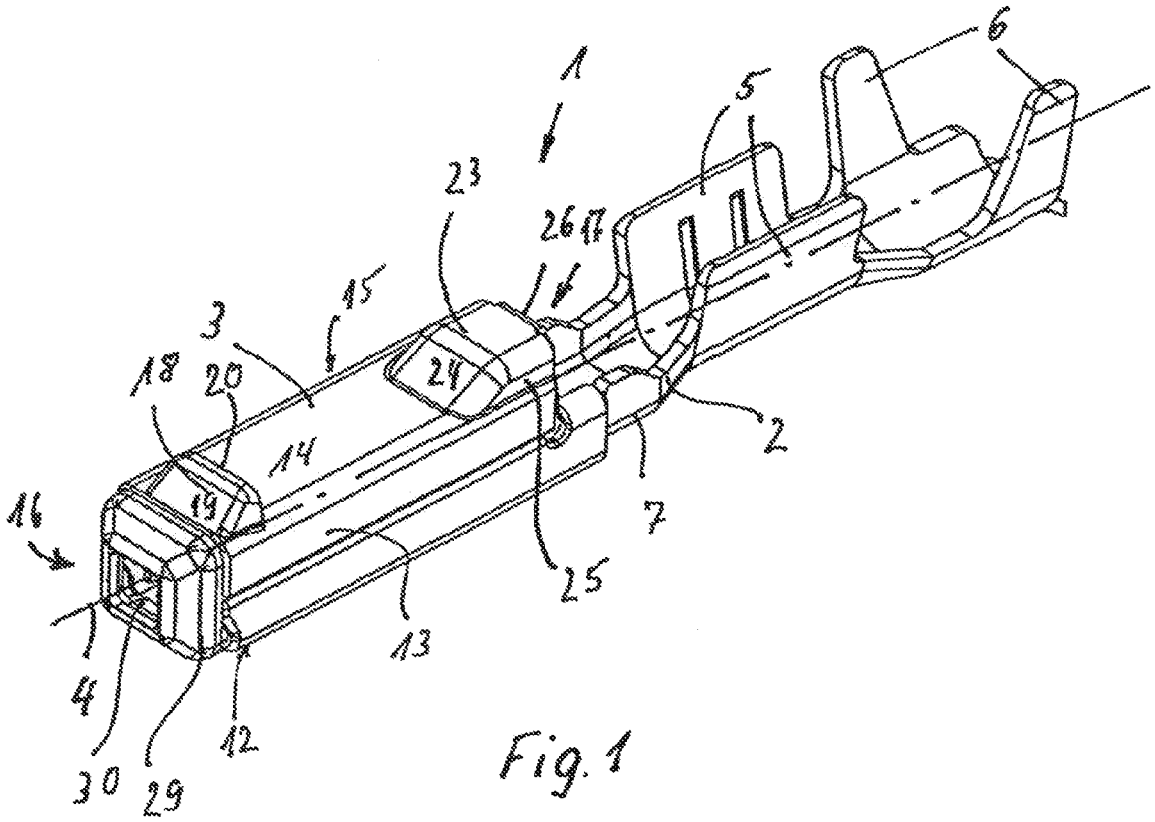
FIG. 1 is a perspective view of a first embodiment of a contact.
Figure 2:
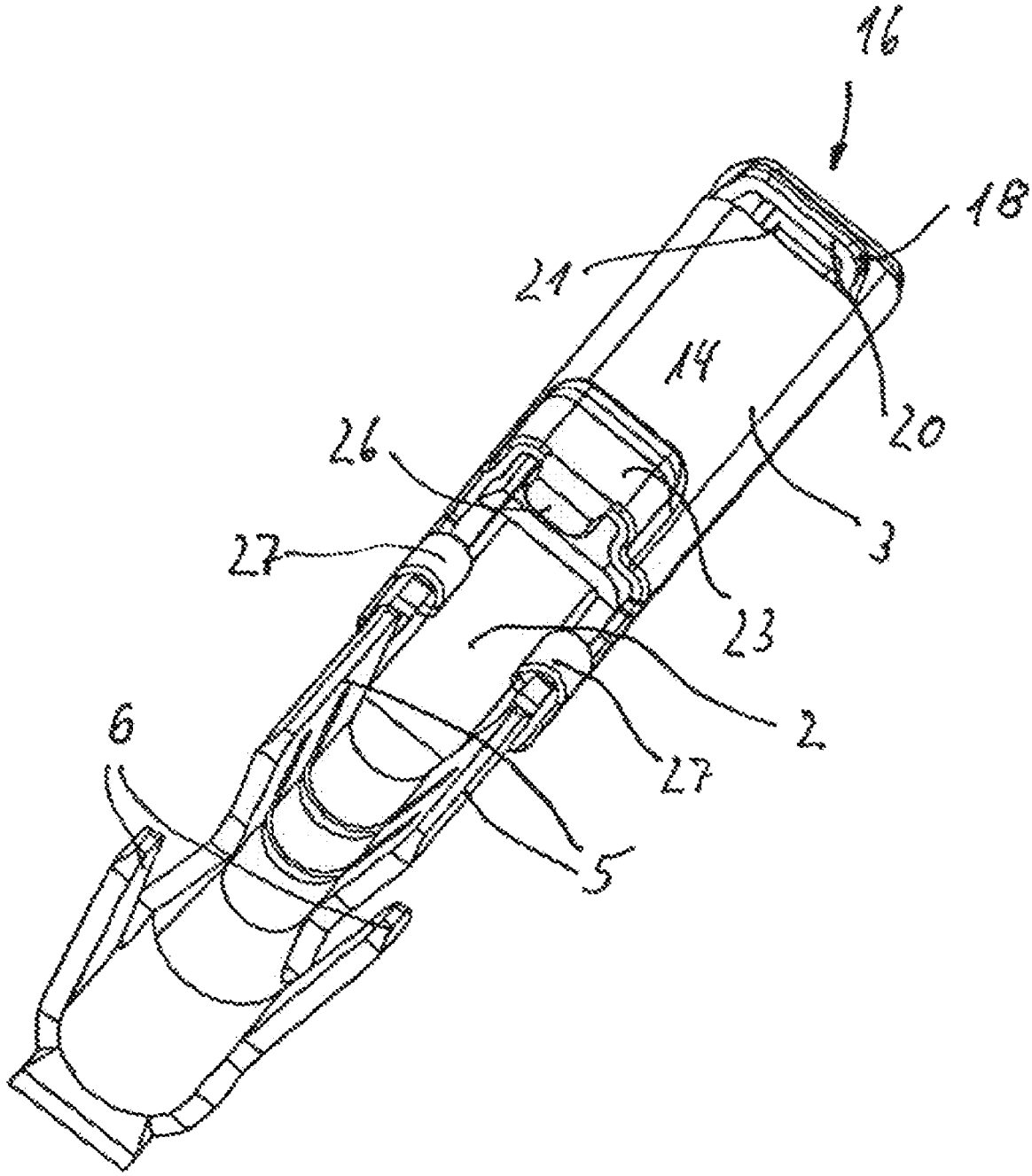
FIG. 2 is the contact of FIG. 1 in a further perspective view.
Figure 3:
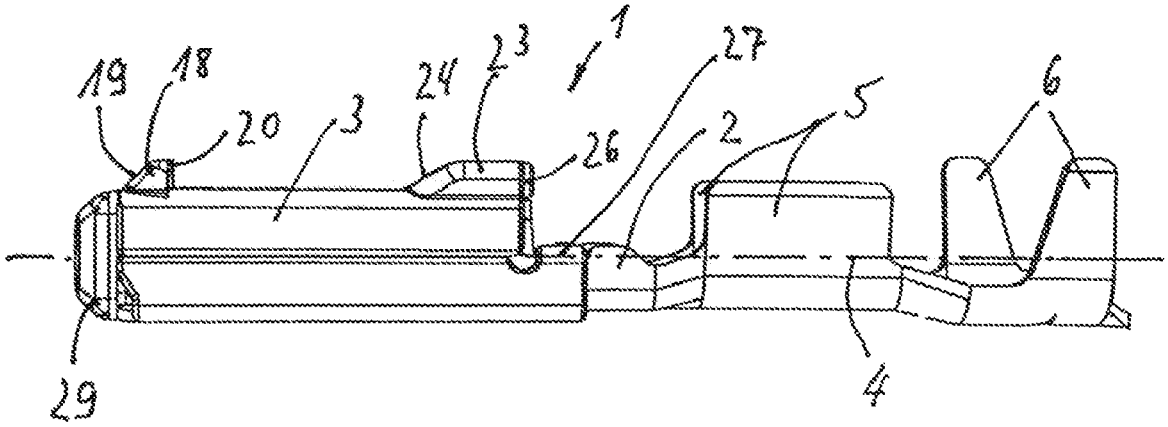
FIG. 3 is a side view of the contact of FIG. 1.
Figure 4:
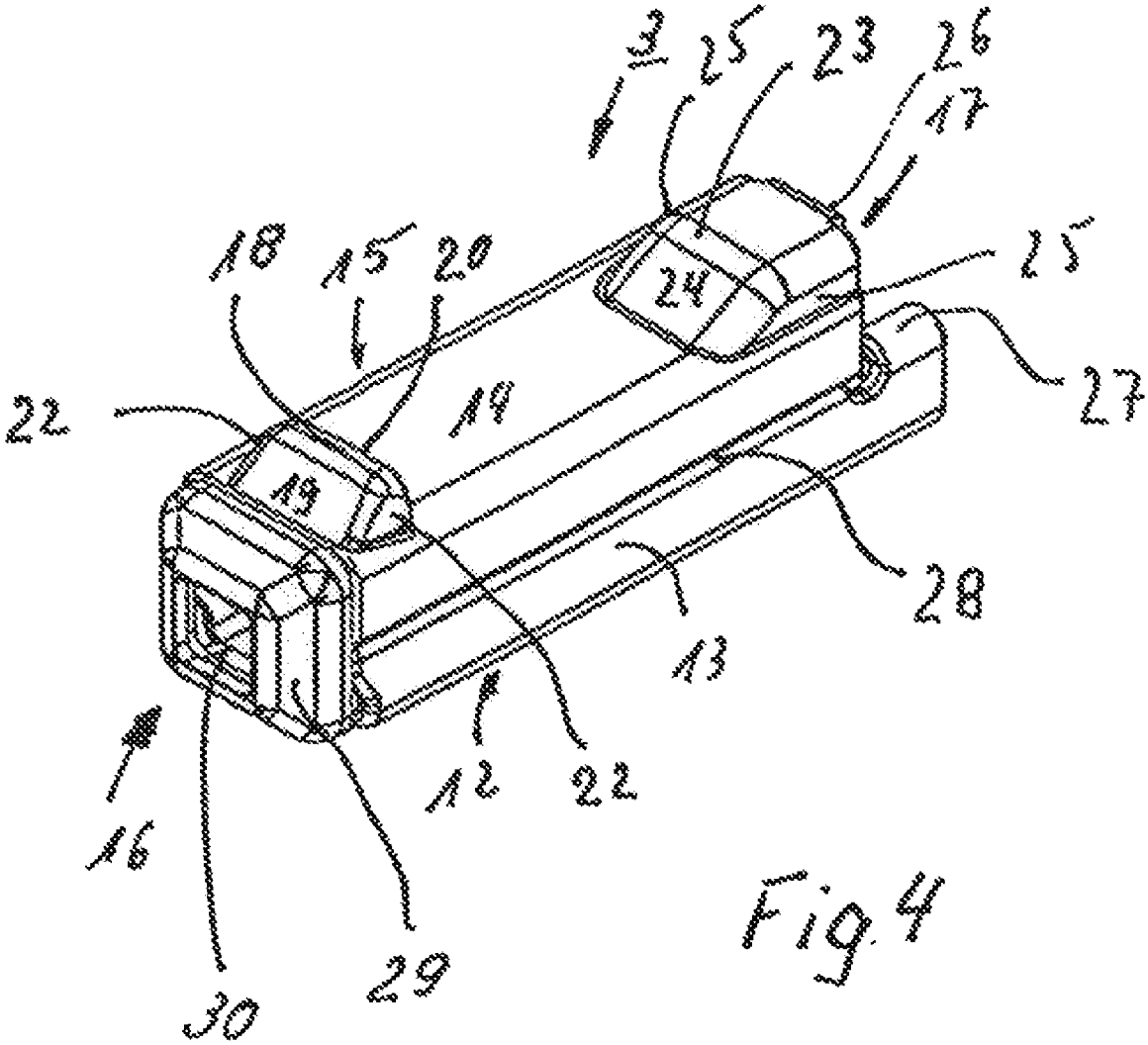
FIG. 4 is the support element as an individual component in a perspective view.
Figure 5:
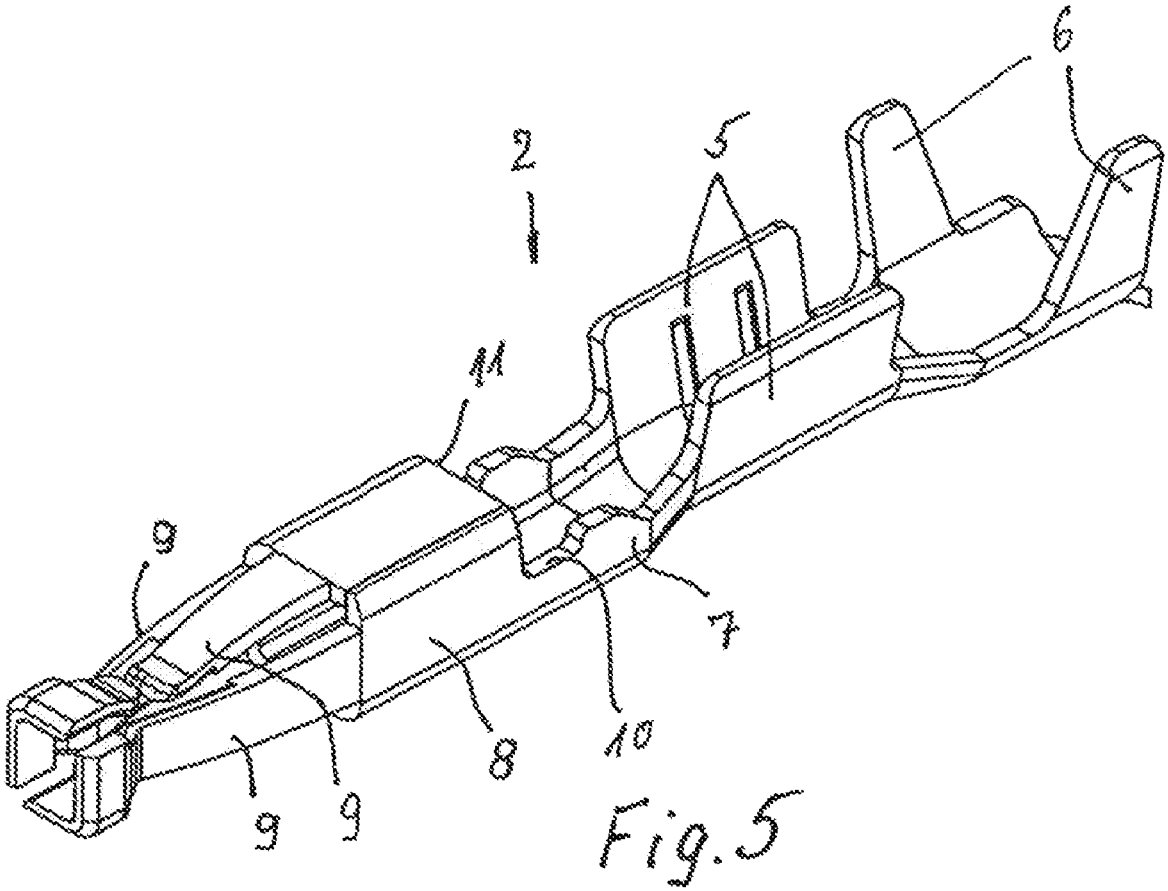
FIG. 5 is the contact element as an individual component, shown in a perspective view.
Figure 6:
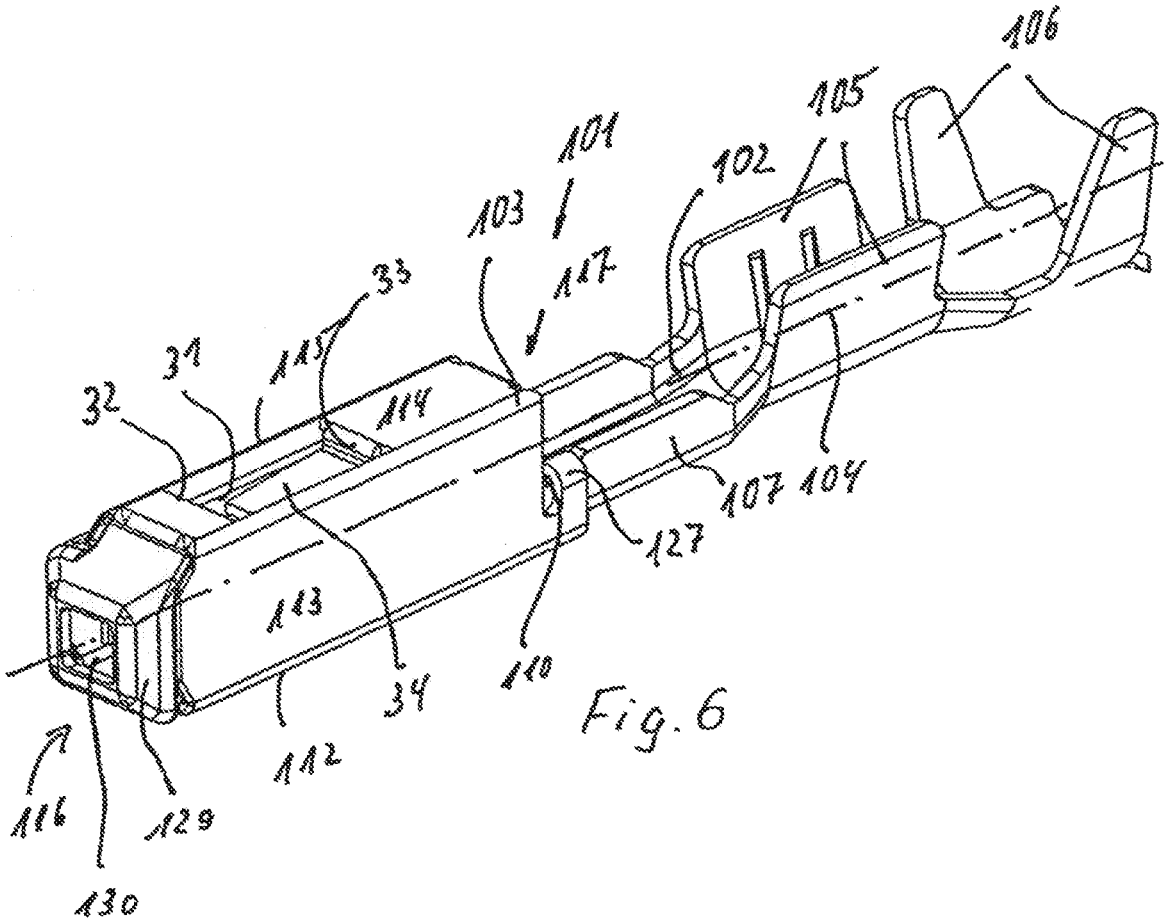
FIG. 6 is a perspective view of a second embodiment of a contact according to the invention.
Figure 7:
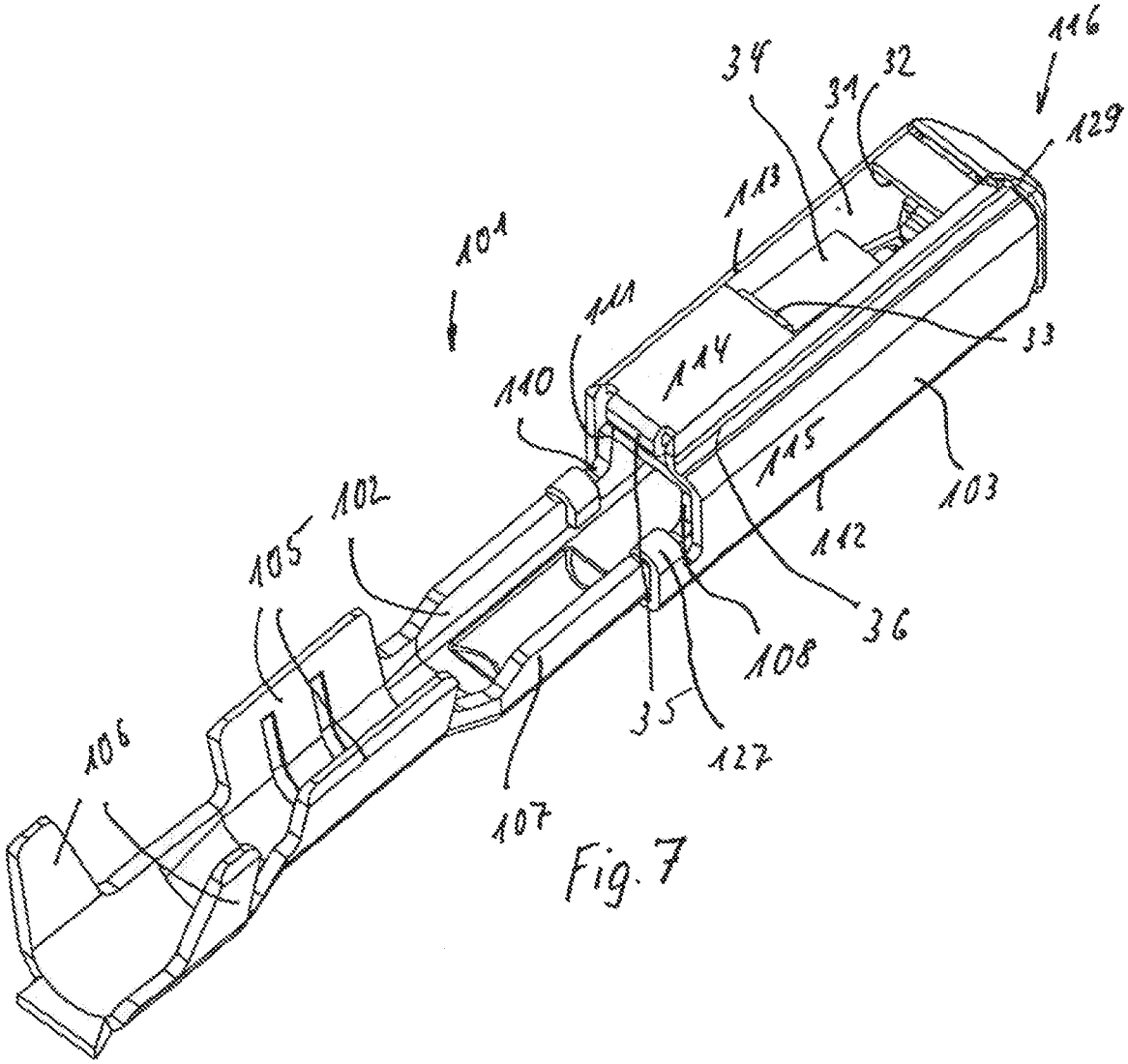
FIG. 7 is a second perspective view with a position of the contact, rotated in relation to the alignment of the contact of FIG. 7.
Figure 8:
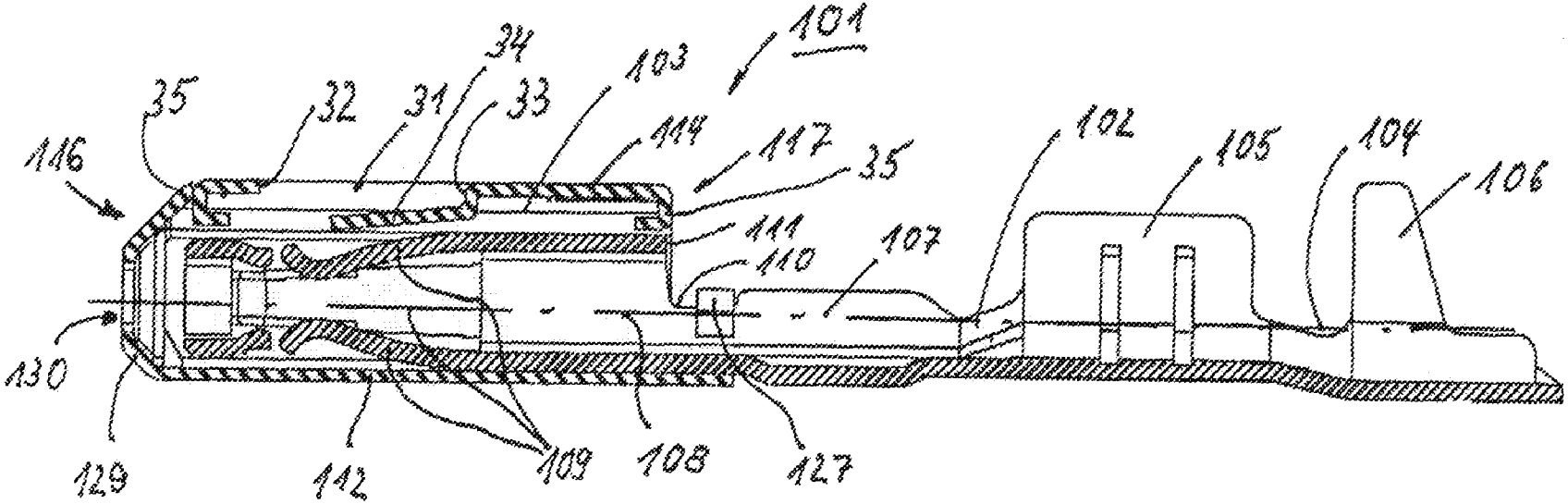
FIG. 8 is a side view of the contact of FIG. 6 in a longitudinal sectional view.
Figure 9:
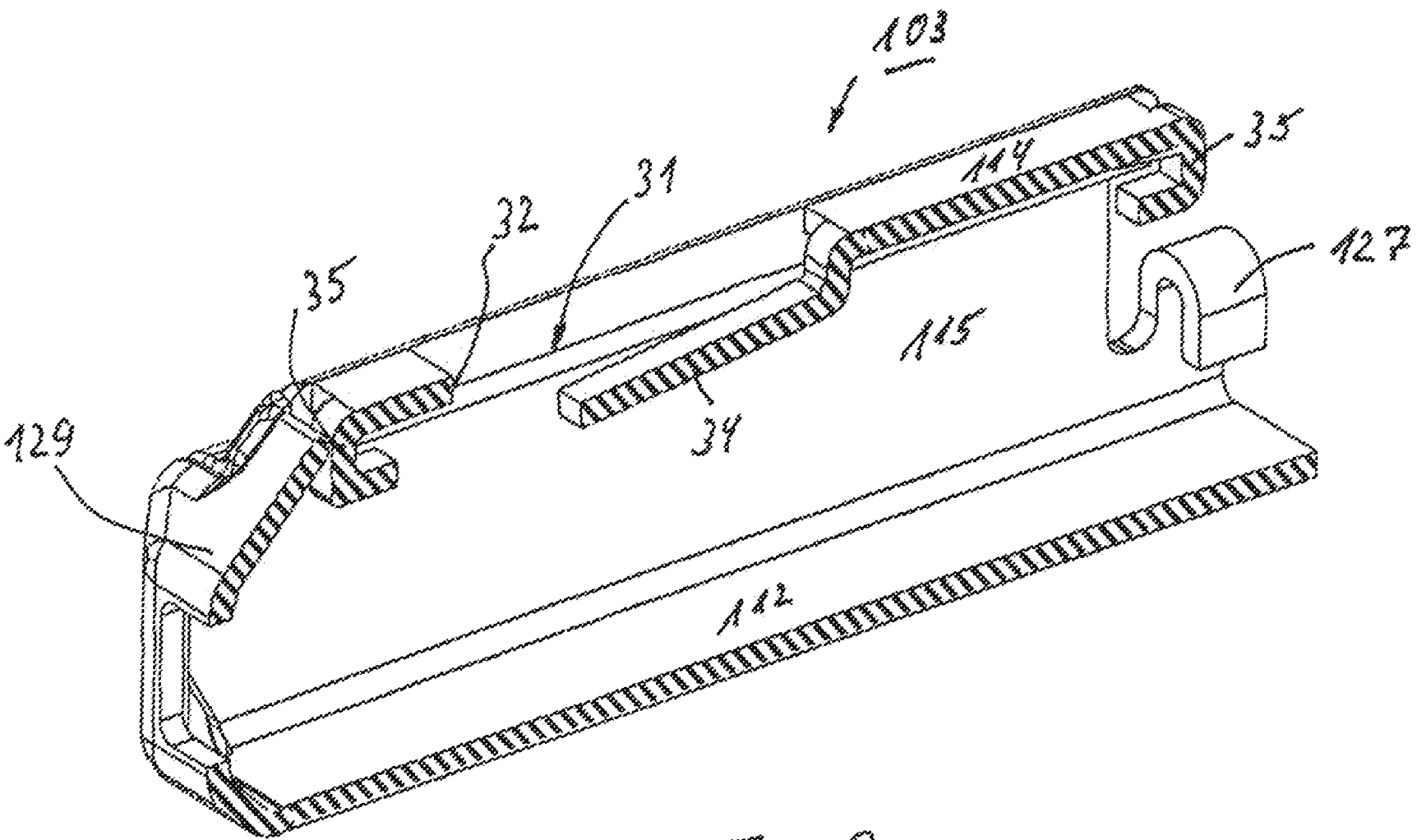
FIG. 9 is the support element of the contact of FIGS. 6 to 8 as an individual part in a perspective manner in a longitudinal sectional view.

The contact 1 consists of the contact element 2 shown as an individual component in FIG. 5 and the support element 3 shown as an individual component in FIG. 4 and which encloses along the longitudinal axis 4 the contact element 2 on a partial length.

The contact element 2 is formed, starting from a sheet metal material having an electrical conductivity, by means of bending. It comprises a connection portion 5, formed by two first crimping tabs and serving for connecting an electrical conductor to the contact element 2 by means of crimping. Furthermore, two second crimping tabs 6 are provided to the right according to FIG. 5 on the connection portion 5 in form of first crimping tabs and two second crimping tabs 6 are offset to each other along the longitudinal axis 4 in such a way, that they are arranged one after the other after the crimping to the insulation of a cable having the conductor along the longitudinal axis 4. The first crimping tabs 5 and the second crimping tabs 6 start from a bottom portion, which is extended away from the second crimping tabs 6 beyond the first crimping tabs 5 and forms a connection portion 7, which is followed by a contact holding portion 8. This contact holding portion 8 is formed in a first portion following the connection portion 7 as a hollow rectangular profile, wherein at the end thereof, which is facing away from the connection portion 5, contact arms 9 are attached. The contact arms 9 are formed elastically and serve to accommodate and to contact a connector pin, for example in the form of a flat connector pin, so that to this flat connector pin, belonging to a mating contact, an electrically conductive connection is produced. In the direction towards the connection portion 5 the contact holding portion 8 ends with the end edge 11. At the connection portion 5, directly following the end edge 11, two recesses 10 are provided, which are formed in the walls of the intermediate portion 7 erected by means of bending.

The contact holding portion 8 and the contact arms 9 of the contact element 2 are enclosed by a support element 3. This support element 3 has also a hollow rectangular cross-section transversally to the longitudinal axis 4. This hollow rectangular cross-section is enclosed by four walls, namely a first wall 12, a second wall 13, following at a right angle thereto, a third wall 14 following again thereto, and a fourth wall 15 connecting the third wall 14 and the first wall 12. The support element 3 has a front end 16 and a rear end 17, wherein the term end is not a definitive end, but an end area or end portion.

The support element 3 is formed, starting from a sheet metal portion, having a corresponding pre-form, wherein this is preferably made from a material, which has a higher strength than the contact element 2. Preferably a steel is used, i.e. especially a steel having spring characteristics and which is non corrosive. The support element 3 has, away from the longitudinal axis 4, two projections, formed by non-cutting working from the base material of the sheet metal portion forming the third wall 14, namely a first projection 18, close to the front end 16, and a second projection 23, close to the rear end 17. The first projection 18 is formed from the sheet metal portion forming the third wall 14 such, that initially transversally to the longitudinal axis 4 a linear cut is made, so that before the bending to the rectangular form a first projection 18 can be pushed out. In this case, towards the front end 16 a first insertion portion 19 is produced, which forms an inclined face, which distance to the longitudinal axis 4 increases along the longitudinal axis from the front end 16 in a direction towards the rear end 17, i.e. extends in an inclined manner. During the forming, the first projection 18 remains connected also via the side walls 22 to the third wall 14, while at the end of the first projection 18 facing to the rear end 17, an end edge 20 is produced and thus, towards the third wall 14 an opening 21 or an open portion 21, respectively, is formed.

Towards the rear end 17, a second projection 23 is provided, which has in the direction towards the first projection 18 a second insertion portion 24. This is also provided as a face portion, which extends starting from the third wall 14 in an inclined manner in a direction towards the rear end 17, i.e. with increasing distance from the longitudinal axis 4 and which ends in a head portion extending approximately parallel to the longitudinal axis 4. This head portion ends at the rear end 17 in the end wall 26 bent inwardly, i.e. in a direction towards the longitudinal axis 4. The side walls 25 of the second projection 23 are still connected integrally after the forming, as those of the first projection 18, to the third wall 14.

Further, the second wall 13 is formed from two portions of the sheet metal portion for the support element 3, wherein these abut each other forming a butt joint 28 and which for example can be connected by one of more welding spots. One of these portions forms tabs 27, which after the assembly of the support element 3 on the contact element 2 are bent inwardly such, that they engage in the recesses 10 and enclose the erected wall portions of the intermediate portion 7, so that a retainment of the support element 3 is achieved along the longitudinal axis 4 on the contact element 2 or its contact holding portion 8, respectively. In the direction towards the front end 16 the tabs 27 are supported on the end edge 11 and in the opposite direction on the edges of the intermediate portion 7 formed by the recesses 10.

The front end of the support element 3 is closed by a cap portion 29, which leaves centrally an opening 39, through which, for example, a flat connector pin can be inserted, to bring the same into contact with the contact arms 9 of the contact element 2 enclosed by the support element 3. The cap portion 29 is also manufactured by means of punching and deforming a portion of the sheet metal portion for forming the support element 3. The cap portion 29 is also preferably formed integrally with a portion of the sheet metal portion forming one of the side walls 12, 13, 14, 15. Of the remaining circumferential edges of the cap portion 29, which do not form a unit with the sheet metal portion, one or more can be connected to the walls by means of a welding seam or spot welding in a material connecting manner or mechanically by means of other measures.

It is further visible, that the two projections 18, 23 are arranged at a right angle to the longitudinal axis 4 not centrally on the third wall 13, but are offset to one side. This can be used, to insert the contact 1 in the correct orientation into an accommodation chamber of a connector housing accommodating the same and having a corresponding shape.

As such connectors, when they are used in a moist environment or in a spray-water endangered environment, have to be sealed, so that during the assembly of the contact element 2, the contact element 2 has to be inserted through the seal. When doing this, because of the extension of the two insertion portions 19, 24 and the form of the two projections 18, 23 with their side walls 22 or 25, respectively attached to the insertion portions 19, 24, damages to the seals are prevented. After the insertion of such a contact 1 into a corresponding accommodation chamber of a connector housing, the first projection 18 with its end edge 20 is supported on a corresponding support face of an elastic locking arm of the corrector housing, so that a pulling-out of the contact 1, when pulling at a cable attached to the connection portion 5 and the second crimping tabs 6, no movement in the direction towards the rear end 17 is possible. However, to achieve a further retainment, often a secondary locking means is used, which is inserted transversally to the longitudinal axis 4 into the connector housing behind the end wall 26. In the direction towards the front end 16, a pushing out of the connector housing is generally prevented, as a corresponding projecting wall of the connector housing is arranged opposite to the cap portion 29. Further, via the cable, practically no pressure forces can act onto the contact 1. Thus, the retainment against pulling-out due to pulling at a connected cable is especially important. The two projections 18, 23 can be formed in the sheet metal portion. The same is also valid for the cap portion 29. Only then the bending into the final form is carried out.

A second contact according to the invention is shown in FIGS. 6 to 9 and is described by means of the same in more detail. In this case especially the differences, which are achieved compared to the embodiment of FIGS. 1 to 5, are described in detail. The same parts or the same portions in the contact 101 of FIGS. 6 to 9 have reference numerals, which are, compared to the corresponding parts and portions of the first embodiment, increased by the numerical value 100. For their description it is referred to the description concerning FIGS. 1 to 6.

Especially the contact element 102 of FIGS. 6 to 9 corresponds to that of the contact 2 of FIGS. 1 to 5. However, the support element 103 is formed differently to the support element 3. The support element 103 has also a cross-section transversally to the longitudinal axis 104, which is formed as a hollow rectangular cross-section. It also has the four walls 112, 113, 114, 115, wherein, however, between the fourth walls 115 and the third wall 114 a step 36 is formed, which is used for the positional alignment of the contact 101 in a mating connector housing.

The fourth wall 114 has a through opening, i.e. a portion of the wall 114 is separated at three sides, so that a rectangular recess 31 is achieved, which is delimited towards the front end 116 by the end edge 32, while towards the rear end an edge 33 is achieved, which is, however, formed by a portion of a tongue 34, extending inwardly, i.e. towards the longitudinal axis 104, and which is, following thereto, again bent, so that it extends generally in a direction towards the front end 116, but ends distinctly in front of the first end edge 32. It is, furthermore, inclined in a direction to the front end 116 towards the longitudinal axis 104. It can be used, to support for example one of the contact arms 109 against excessive bending. At the front end 116 and the rear end 117, in the area of the fourth wall 114, a wall portion 35 is bent inwardly. From FIGS. 8 and 9 it is visible, that a double bending at a right angle has been carried out. Thus, on the one hand a reinforcement is achieved. On the other hand, the wall portion 35 provided towards the rear end 117 can serve as an abutment for a slider, which can be inserted for a secondary locking of the contact 101 in a connector housing.

What is claimed is:

1. Electrical contact comprising:

a contact element (2), which has a connection portion (5) for an electrically conducting connection to an electrical conductor, has a contact holding portion (8), connected integrally to the connection portion (5), for contacting a mating contact, and a support element (3), which encloses the contact holding portion (8) at least at a length portion thereof along a longitudinal axis (4) and formed in cross-section as a hollow rectangle delimited by four walls (12, 13, 14, 15), has along the longitudinal axis (4) a front end (16) and a rear end (17), with the rear end (17) facing the connection portion (5), has a first projection (18) close to the front end (16), which first projection (18) has a first insertion portion (19) which distance from the longitudinal axis (4) increases in a direction from the front end (16) towards the rear end (17) and has side walls (22) and ends with an end edge (20), has a second projection (23) close to the rear end (17), which second projection (23) has a second insertion portion (24), which distance to the longitudinal axis (4) increases in a direction towards the rear end (17) in an inclined manner away from the first projection (18) relative to the longitudinal axis (4), wherein the first projection (18) as well as the second projection (23) are formed by non-cutting working from one of the walls (12, 13, 14, 15), so that they project away from the longitudinal axis (4) from that wall (14).

2. Electrical contact according to claim 1, wherein the first projection (18) and the second projection (23) even after the non-cutting forming in situ from the base material of the wall (14) of the support element (3), to which wall (14) they are arranged, are connected via their side walls (22, 25) to this wall (14), while the end edge (20) of the first projection (18) is separated from the base material of the wall (14) and serves as a support base for the locking arm of a connector.

3. Electrical contact according to claim 1, wherein the front end (16) of the support element (3) has a cap portion (29) with a central through opening (30), and that the cap portion (29) is formed integrally with one (12) of the four walls (12, 13, 14, 15).

4. Electrical contact according to claim 3, wherein the cap portion (29) is connected to at least one of the remaining walls.

5. Electrical contact according to claim 1, wherein the second projection (23) has towards the rear end (17) a wall portion (26) bent in a direction towards the longitudinal axis (4).

6. Electrical contact according to claim 1, wherein the support element (3) is formed from a sheet portion by means of non-cutting forming the two portions (18, 23) and the cap portion (29) and by bending into the final shape.

7. Electrical contact according to claim 6, wherein the two projections (18, 23) and the cap portion (29) are formed on a portion of the sheet metal portion, which sheet portion forms the wall (14) to be provided with the projections (18, 23).

8. Electrical contact according to claim 2, wherein the first projection (18) has in the direction towards the second projection (23) an open portion (21).

9. Electrical contact according to claim 1, wherein the contact holding portion (108) has elastic contact arms (109), which accommodate between them a counter contact formed as a connector pin or a flat connector pin.

* * * * *